US011286950B2

(12) United States Patent
Haack

(10) Patent No.: US 11,286,950 B2
(45) Date of Patent: Mar. 29, 2022

(54) BRIDGED STAGE PIECE

(71) Applicant: Sulzer Management AG, Winterthur (CH)

(72) Inventor: Ryan Haack, Eugene, OR (US)

(73) Assignee: SULZER MANAGEMENT AG, Winterthur (CH)

( * ) Notice: Subject to any disclaimer, the term of this patent is extended or adjusted under 35 U.S.C. 154(b) by 139 days.

(21) Appl. No.: 16/780,352

(22) Filed: Feb. 3, 2020

(65) Prior Publication Data

US 2021/0156398 A1 May 27, 2021

Related U.S. Application Data

(60) Provisional application No. 62/941,353, filed on Nov. 27, 2019.

(51) Int. Cl.
*F04D 29/44* (2006.01)

(52) U.S. Cl.
CPC ..... *F04D 29/44* (2013.01); *F05B 2240/14* (2013.01)

(58) Field of Classification Search
CPC . F04D 1/06; F04D 1/063; F04D 1/066; F04D 29/40; F04D 29/42; F04D 29/44
See application file for complete search history.

(56) References Cited

U.S. PATENT DOCUMENTS

| | | | | |
|---|---|---|---|---|
| 3,861,825 | A | 1/1975 | Blom | |
| 5,207,560 | A * | 5/1993 | Urban | F04D 7/06 277/411 |
| 9,803,644 | B2 * | 10/2017 | Bergamini | F04D 1/10 |
| 2010/0014963 | A1 | 1/2010 | Hirschberger et al. | |
| 2021/0246907 | A1 * | 8/2021 | Shaffer | F04D 1/06 |

* cited by examiner

*Primary Examiner* — Brian P Wolcott
*Assistant Examiner* — Jackson N Gillenwaters
(74) *Attorney, Agent, or Firm* — Global IP Counselors, LLP

(57) ABSTRACT

A stage piece for a multistage pump includes a first ring, a second ring, and a post. The connects the first ring to the second ring and has a first radial end and a second radial end and a first side and a second side connecting the first and second ends. The first and second sides are arcuate and extend toward each other such that the first radial end is longer that the second radial end.

18 Claims, 8 Drawing Sheets

BRIDGED STAGE PIECE

CROSS-REFERENCE TO RELATED APPLICATION

This application claims benefit of U.S. Provisional Application No. 62/941,353, filed Nov. 27, 2019, the contents of which are hereby incorporated herein by reference.

BACKGROUND

Field of the Invention

This invention generally relates to a bridged stage piece for multistage pump. In particular, the invention relates to a bridged stage piece for multistage double volute pumps in which the volute case is of an axial split design.

Background Information

Conventional multistage pumps or multistage double volute pumps generally include opposed impeller designs. The opposed impellers are disposed facing opposite directions in order to balance the axial thrust generated by the rotating element. Some conventional multistage pumps include bridged stage pieces that are cast if the bridge geometry allows. They typically have at least four bridging posts connecting the two rings.

SUMMARY

It has been discovered that in the conventional multistage pumps the stage pieces are in the middle of the flow path, causing a flow disturbance. Additionally, it has been discovered that conventional posts generally have a thin cross section, making the conventional posts difficult to cast without the propagation of cracks. Moreover, it has been discovered that if repeated attempts to cast the conventional design (which typically included four posts) fail, then often the component would need to formed via weld fabrication.

In view of the state of the known technology, a first aspect of the present disclosure is to provide a stage piece for a multistage pump includes a first ring, a second ring, and a post. The connects the first ring to the second ring and has a first radial end and a second radial end and a first side and a second side connecting the first and second ends. The first and second sides are arcuate and extend toward each other such that the first radial end is longer that the second radial end.

A second aspect of the present invention is to provide the stage piece according to the first aspect wherein the first radial end is arcuate.

A third aspect of the present invention is to provide the stage piece according to the first or second aspects wherein the second radial end extends radially inwardly of first and second rings.

A fourth aspect of the present invention is to provide the stage piece according to the first through third aspects wherein the second radial end includes a radially inwardly extending protrusion, A fifth aspect of the present invention is to provide the stage piece according to the first through fourth aspects wherein the post is a first post and a second post connects the first ring to the second ring.

A sixth aspect of the present invention is to provide the stage piece according to the first through fifth aspects wherein the second post is disposed in a position 180 degrees relative to the first post.

A seventh aspect of the present invention is to provide the stage piece according to the first through sixth aspects wherein the post includes an upper surface that is angled in a axial direction.

An eighth aspect of the present invention is to provide the stage piece according to the first through seventh aspects wherein the post is configured to mimic a hydraulic contour of a flow passage in an upstream part of a casing of the multistage pump.

A ninth aspect of the present invention is to provide the stage piece according to the first through eighth aspects wherein the first ring, the second ring and the post are unitarily formed as one piece.

A tenth aspect of the present invention is to provide the stage piece according to the first through ninth aspects wherein the first ring, the second ring and the post are cast as one piece.

An eleventh aspect of the present invention is to provide a multistage pump, comprising a pump casing defining a flow passage, a shaft rotatably disposed within the pump casing and having a longitudinal axis, a first impeller disposed within the casing at a first position along the shaft, a second impeller disposed within the casing at a second position and along the shaft, and a stage piece disposed in the flow passage and including a first ring, a second ring, and a post connecting the first ring to the second ring having a first radial end and a second radial end and a first side and a second side connecting the first and second ends, the first and second sides being arcuate and extending toward each other such that the first radial end is longer that the second radial end.

A twelfth aspect of the present invention is to provide the multistage pump according to the eleventh aspect wherein the first radial end is arcuate.

A thirteenth aspect of the present invention is to provide the multistage pump according to the eleventh or twelfth aspect wherein the second radial end extends radially inwardly of first and second rings.

A fourteenth aspect of the present invention is to provide the multistage pump according to the eleventh through thirteenth aspect wherein the second radial end includes a radially inwardly extending protrusion, A fifteenth aspect of the present invention is to provide the multistage pump according to the eleventh through fourteenth aspect wherein the post is a first post and a second post connects the first ring to the second ring.

A sixteenth aspect of the present invention is to provide the multistage pump according to the eleventh through fifteenth aspect wherein the second post is disposed in a position 180 degrees relative to the first post.

A seventeenth aspect of the present invention is to provide the multistage pump according to the eleventh through sixteenth aspect wherein the post includes an upper surface that is angled in a axial direction.

An eighteenth aspect of the present invention is to provide the multistage pump according to the eleventh through seventeenth aspect wherein the post is configured to mimic a hydraulic contour of a flow passage in an upstream part of a casing of the multistage pump.

A nineteenth aspect of the present invention is to provide the multistage pump according to the eleventh through eighteenth aspect wherein the first ring, the second ring and the post are unitarily formed as one piece.

A twentieth aspect of the present invention is to provide the multistage pump according to the eleventh through nineteenth aspect wherein the first ring, the second ring and the post are cast as one piece.

These aspects of the invention provide an improved bridged stage piece that is more efficient, saving energy. Further the two-post design shaped to mimic the hydraulic contour of the flow passage in the upstream part of the assembly limits the efficiency loss by better guiding the flow into the eye of the downstream impeller, which can save energy.

Embodiments of the present invention can also be substantially thicker and better suited for metal flow between the two rings during the casting process than previous designs. Thus, embodiments of the present invention can save post-production rework and scrap.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
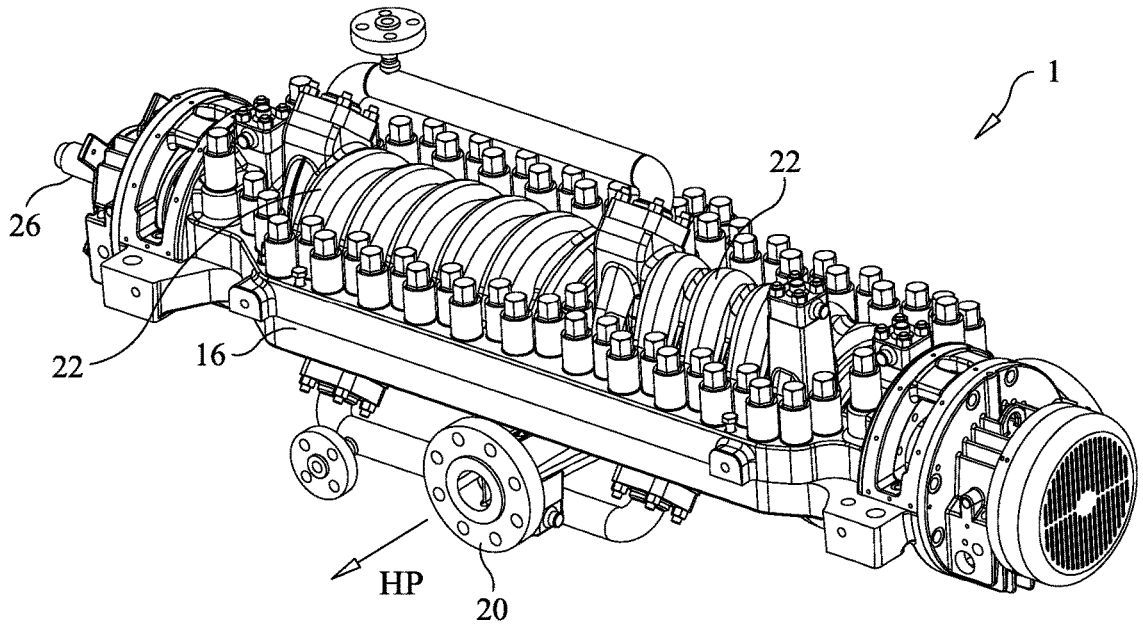
FIG. 1 is a top perspective view of a multistage pump that includes a bridged stage piece according to an embodiment of the invention.
Figure 2:
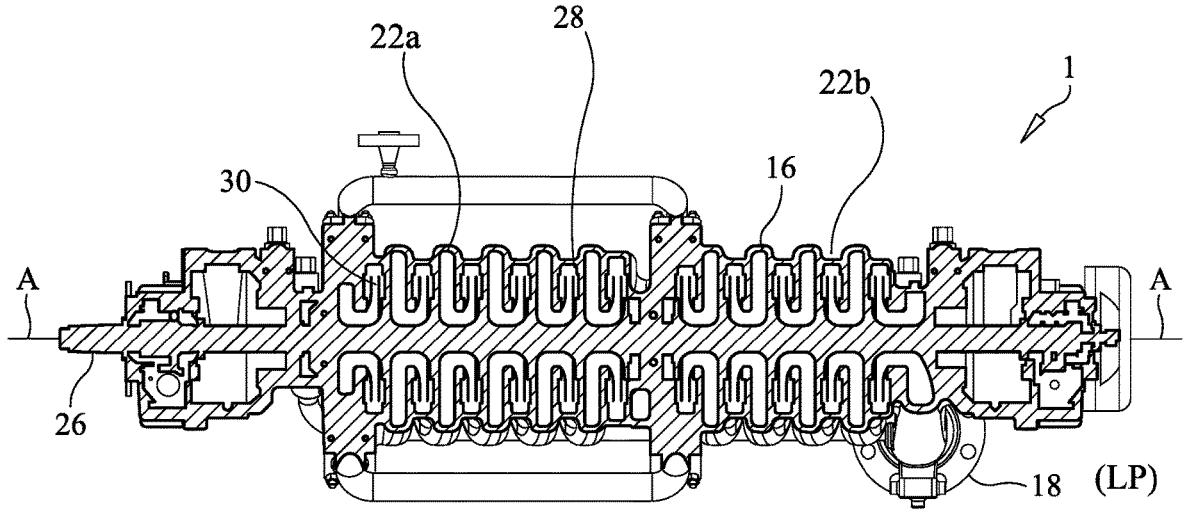
FIG. 2 is a cross sectional view of the multistage pump of FIG. 1.
Figure 3:
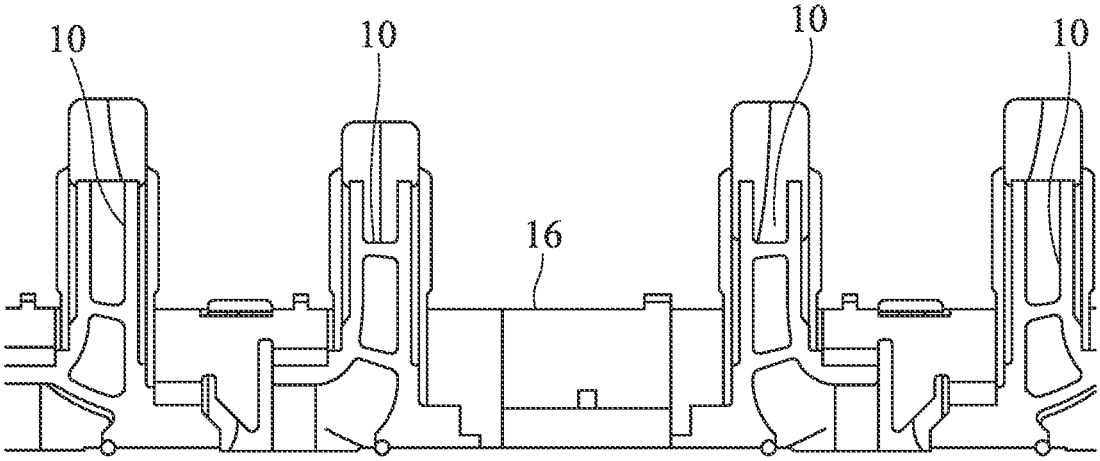
FIG. 3 is a partial cross sectional view of the multistage pump of FIG. 1 showing the bridged stage piece.

Referring initially to FIGS. 1 through 3, a multistage pump 1 that includes a bridged stage piece 10 is illustrated in accordance with a first embodiment. The multistage pump 1 includes a cylindrical pump casing (or housing) 16, the bridged stage piece 10, an impeller shaft 26, a first impeller 28 and a second impeller 30.

The casing 16 includes a pump inlet 18 through which the multistage process fluid enters the pump 1 at the low pressure side LP, and a pump outlet 20 for discharging the process fluid with an increased pressure at the high pressure side HP as indicated by the arrow. Typically, the pump outlet 20 is connected to a pipe or a piping (not shown) for delivering the process fluid to another location. The pressure of the process fluid at the pump outlet 20, i.e. at the high pressure side HP, is typically considerably higher than the pressure of the process fluid at the pump inlet 18, i.e. at the low pressure side LP. A typical value for the difference between the high pressure and the low pressure side is, for example, 50 to 200 bar.

The casing 16 is split "staged" casing 16 with several stage segments 22, which are able to withstand the pressure generated by the multistage pump 1 as well as the pressure exerted on the multistage pump 1 by the environment. The stage segments 22 comprise several different casing parts, which are connected to each other to form the casing 16. Whereby the several stage segments 22 can include a high pressure segment 22*a* disposed on the high pressure side HP at the pump outlet 20, a low pressure segment 22*b* disposed on the low pressure side LP at the pump inlet 18, a and any number of segments desired. FIG. 1 illustrates an embodiment with eleven (11) segments; however, it is noted that there can be as many or as few segments as desired. The stage segments 22 are arranged in tandem and are arranged to form the low pressure segment 22*b* and the high pressure segment 22*a*. The low pressure segment 22*b* can be a suction casing and the high pressure segment 22*a* can be a discharge casing.

The multistage pump 1 further includes a pump rotor rotating about an axial or longitudinal direction A in an operating state of the multistage pump 1. As can be understood, the pump rotor conveys the process fluid from the inlet 18 at the low pressure side LP to a pump outlet 20 (i.e., the discharge) at the high pressure side HP.

The pump rotor includes the shaft 26, which are rotatable about the axial direction A and a plurality of impellers (e.g., in one embodiment, a first impeller 28 and a second impeller 30) arranged in series along the axial direction A for conveying the process fluid from the inlet 18 to the outlet 20 and thereby increasing the pressure of the process fluid. The shaft 26 is rotatably disposed within the pump casing 16 and the first impeller 28 is disposed within the casing 16 at a first position along the shaft 26 and the second impeller is disposed within the casing 16 at a second position and along the shaft 26.

A drive motor can be used to rotate the shaft 26 of the pump rotor. In some embodiments, the motor can be a separate unit located outside the casing 16 of the pump. In other embodiments, the motor can be integrated into the casing 16.

As shown in FIG. 3, the bridged stage piece 10 is disposed within the casing in the flow path of the multistage pump 1. In one embodiment, a plurality of bridged stage pieces 10 are disposed within the casing in the flow path of the multistage pump 1.

The bridged stage piece 10 includes a first ring 34, a second ring 36 and a post 38 connecting the first ring 34 to the second ring 36 having a first radial end and a second radial end and a first side and a second side connecting the first and second ends, the first and second sides being arcuate and extending toward each other such that the first radial end is longer that the second radial end.

As shown in FIGS. 4-12, the bridged stage piece 10 is preferably one piece. That is, in one embodiment, the first ring 34, the second ring 36 and the post 38 are unitarily formed as one piece. In one embodiment the bridged stage piece 10 is cast as one piece. That is, in one embodiment, the first ring 34, the second ring 36 and the post 38 are cast as one piece.

Casting the post 38 and the first and second rings 34 and 36 avoids many issues of the conventional designs. That is, it was found that in the conventional designs the conventional posts required a thin cross section in an attempt to avoid disturbance of the flow. This thin cross-sectional structure of the conventional posts made the posts difficult to cast without the propagation of cracks. As described herein, the post 38 is substantially thicker and better suited for metal flow between the two rings during the casting process. Thus, forming the post 38, as described herein can save post-production rework and scrap.

Moreover, if repeated attempts to cast to the conventional post design fail, then often the component will have to be formed by weld fabrication, which may triple or quadruple the cost. The post 38 avoids such issues due to the configuration described herein. Casting is also the preferred method as casting enables a greater range of available metallurgy of the bridged stage piece 10. Fabrication in exotic metals can be extremely difficult. However, is noted that any suitable material can be used.

The first and second rings 34 and 36 each have an external, circumferential surface 40 and internal surface 42. The internal surfaces define an opening or a through passage 44. The internal and external surfaces 40 and 42 of the first and second rings 34 and 36 are generally parallel, respectively, such that the first and second rings 34 and 36 overlap. In other words, when viewed in the axial or longitudinal direction, the first and second rings 34 and 36 generally occupy the same or a similar position.

The post 38 is disposed between the first ring 34 and second ring 36. That is, the post 38 extends from an inner axial surface 46 of the first ring 34 to an inner axial surface 46 of the second ring 36 so as to connect the first ring 34 to the second ring 36. As stated herein, preferably the post 38 is cast with the first and second rings 34 and 36 to form a unitary one-piece member; however, the post 38 can be connected to the first and second rings 34 and 36 in any manner desired.

Figure 4:
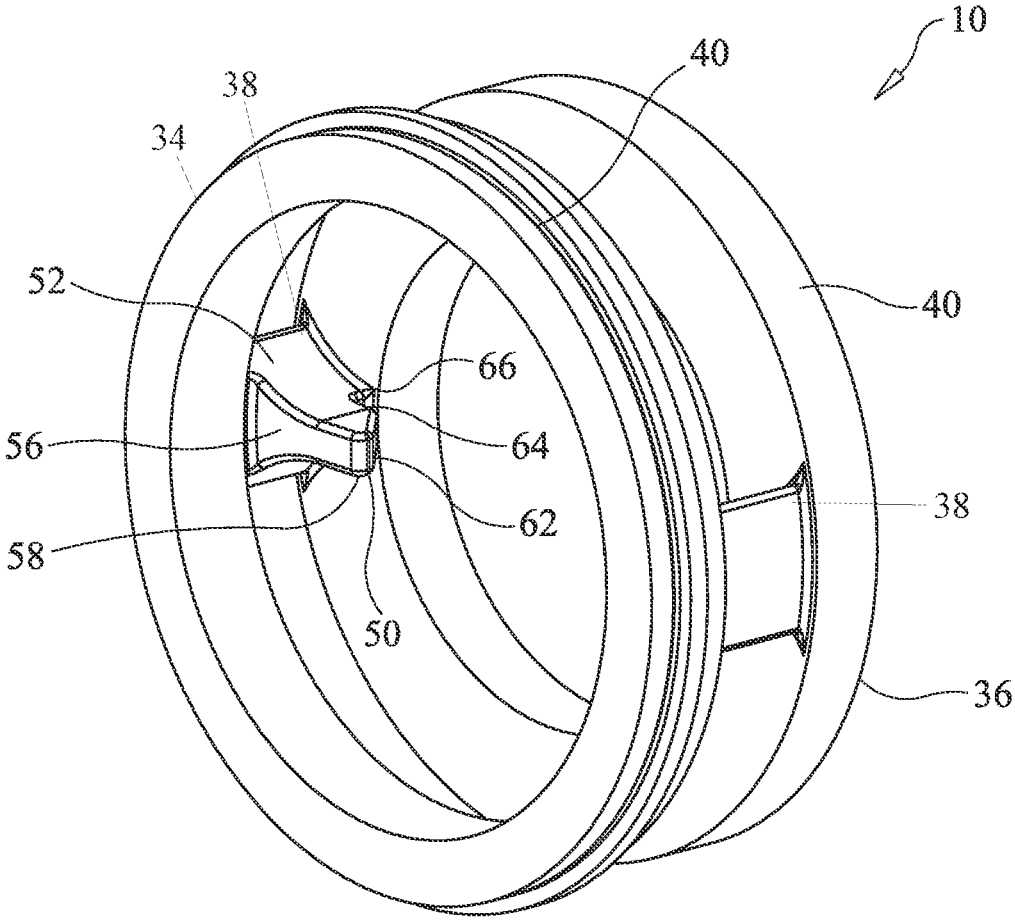
FIG. 4 is a top perspective view of the bridged stage piece of FIG. 3.
Figure 5:
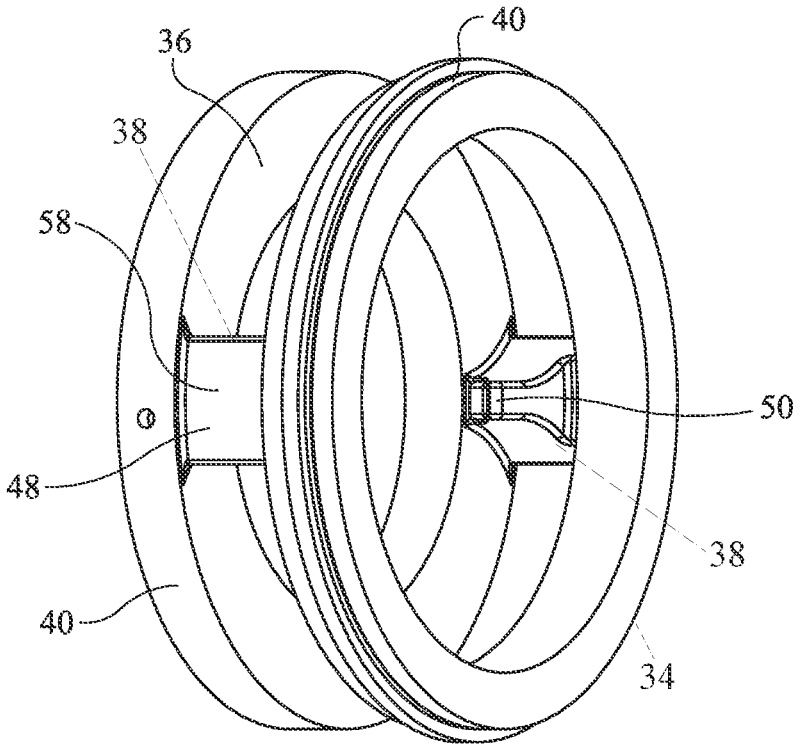
FIG. 5 is a side perspective view of the bridged stage piece of FIG. 3.
Figure 6:
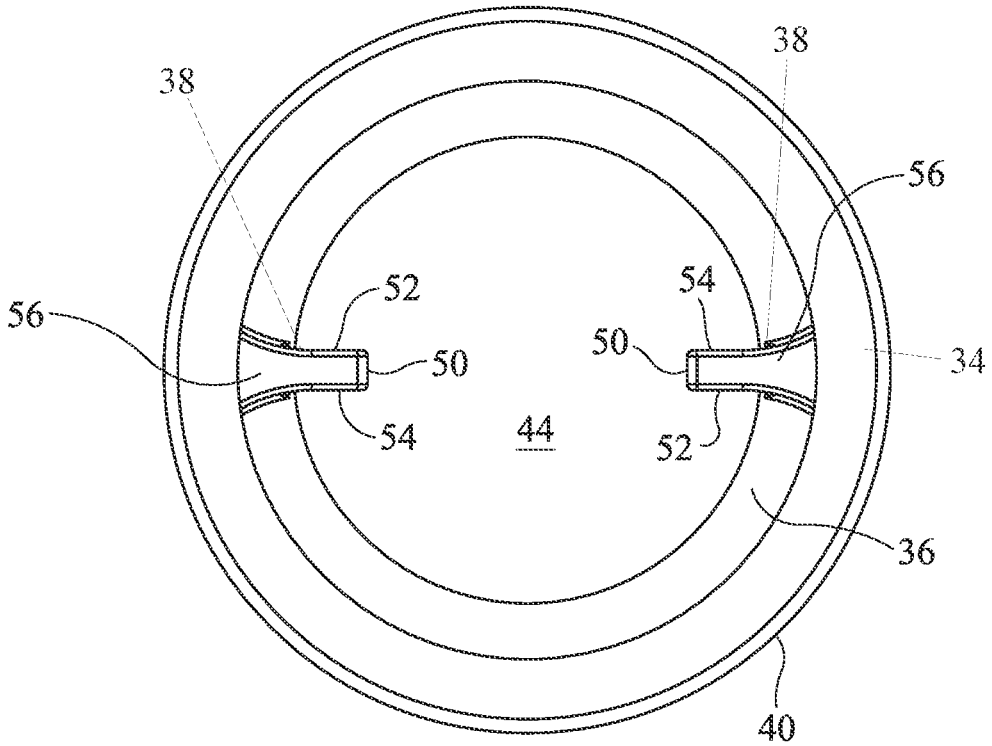
FIG. 6 is a top view of the bridged stage piece of FIG. 3.
Figure 7:
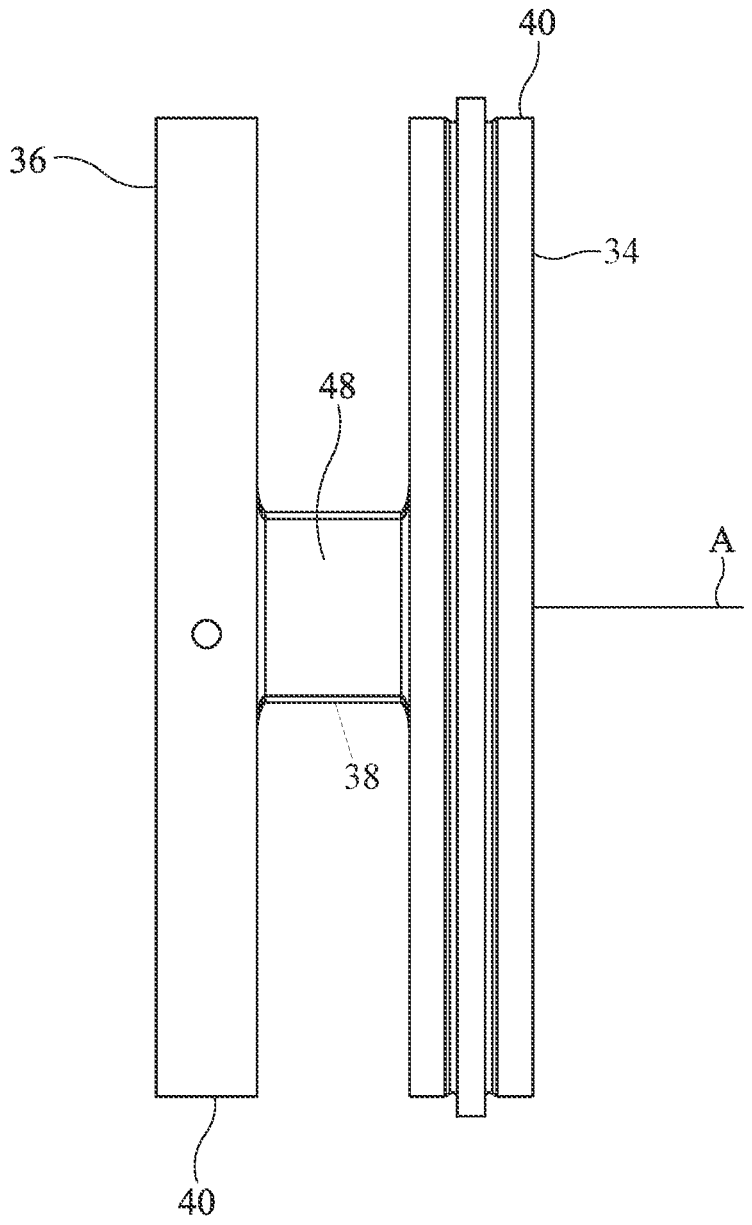
FIG. 7 is a side view of the bridged stage piece of FIG. 3.
Figure 8:
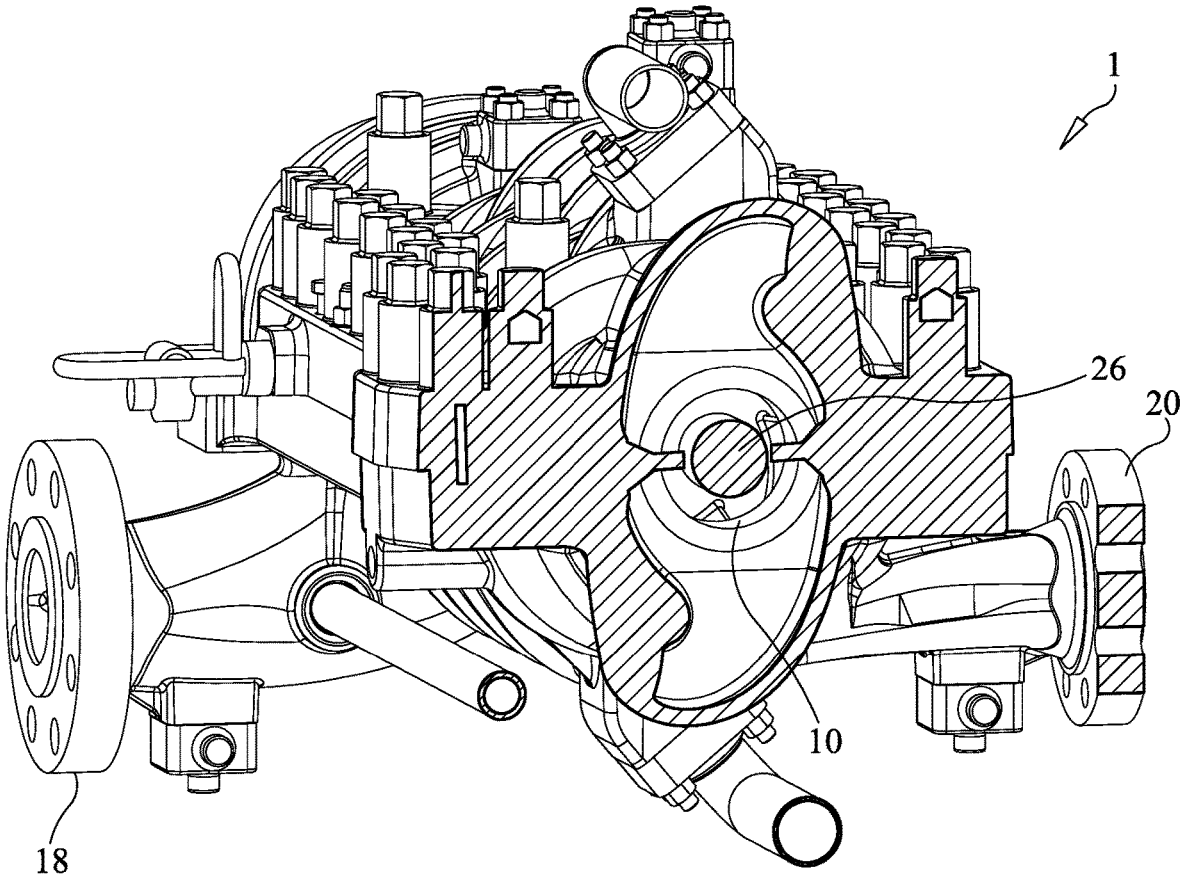
FIG. 8 is a perspective view in section view of the bridged stage piece of FIG. 3 in the casing of the multistage pump.
Figure 9:
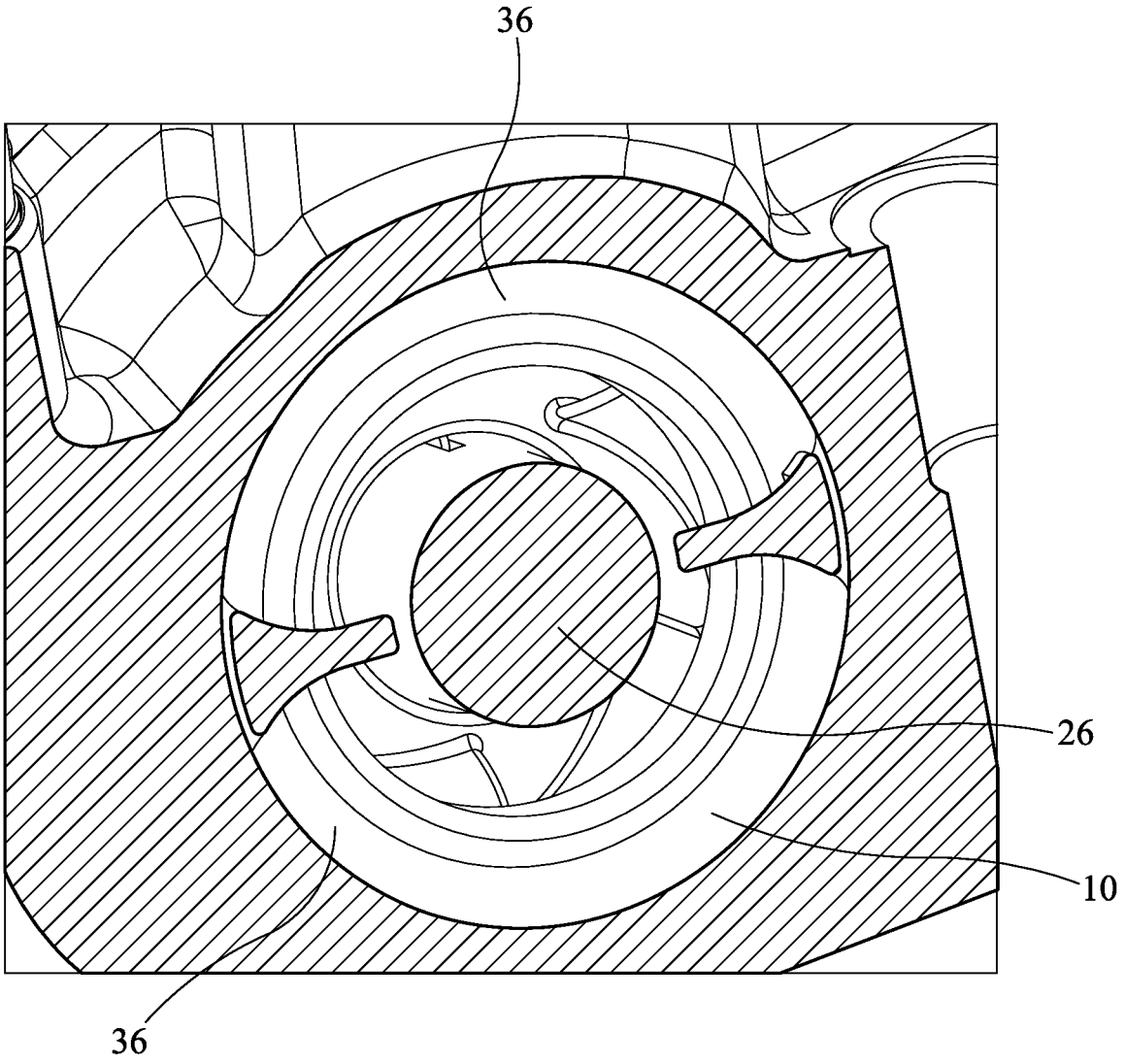
FIG. 9 is an enlarged view of the bridged stage piece shown in FIG. 8.
Figure 10:
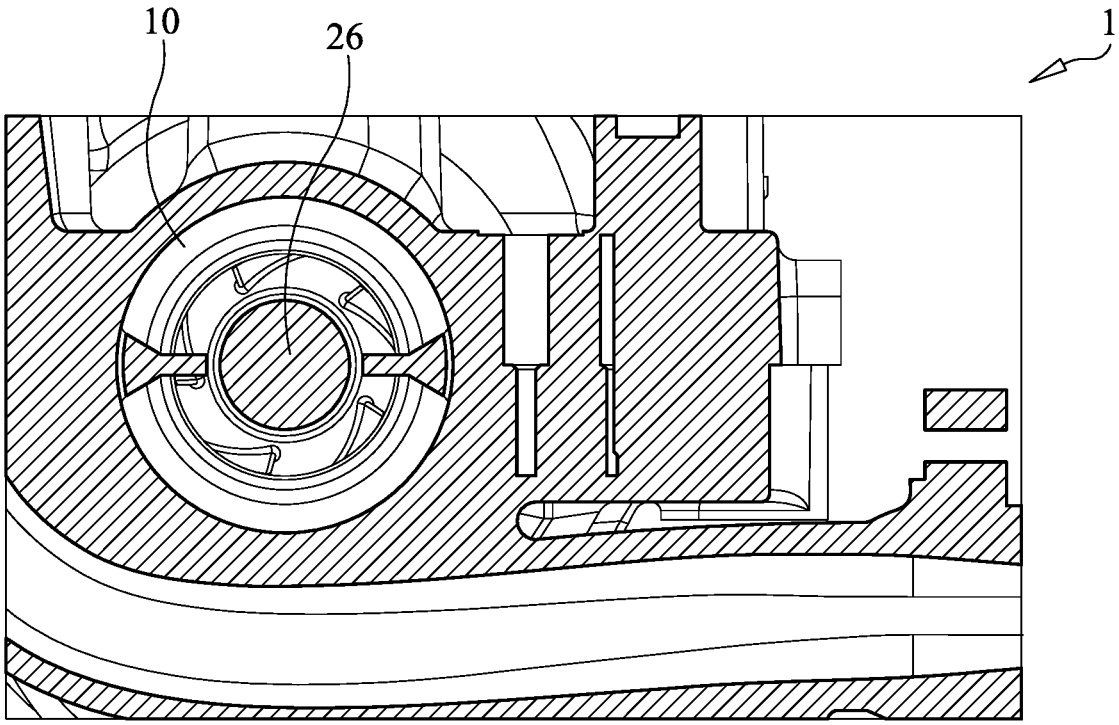
FIG. 10 is a front view of the bridged stage piece shown in FIG. 9.
Figure 11:
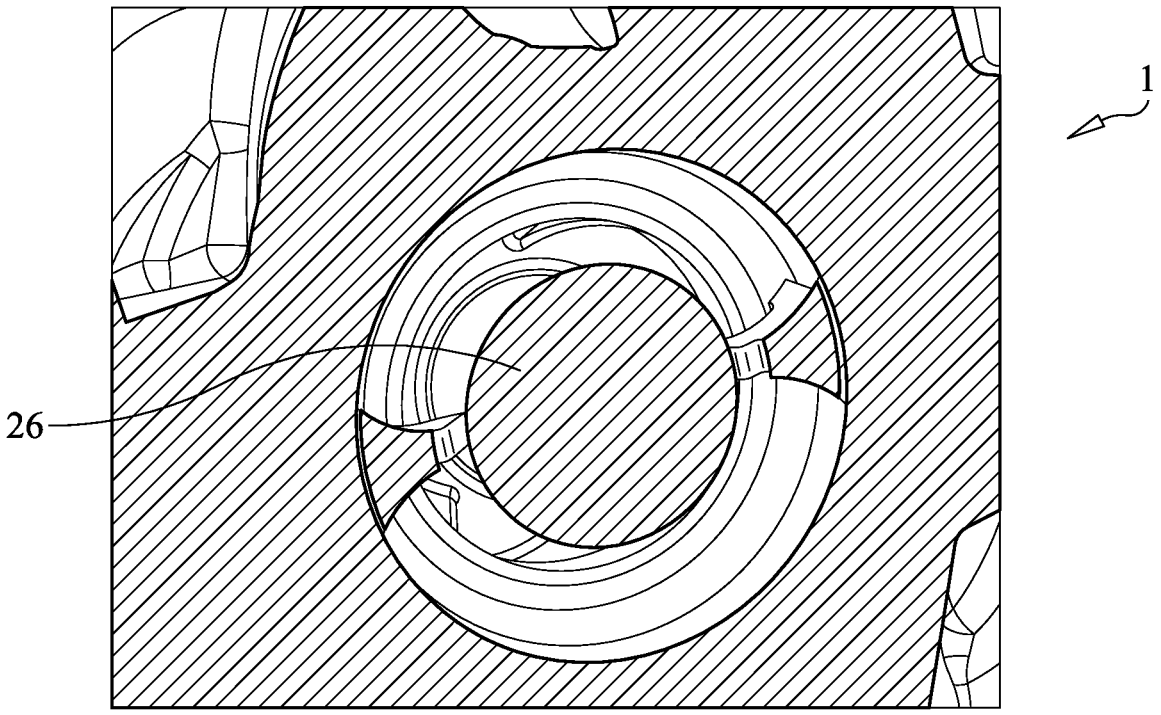
FIG. 11 is a perspective view in section view of the bridged stage piece of FIG. 3 in the casing of the multistage pump.
Figure 12:
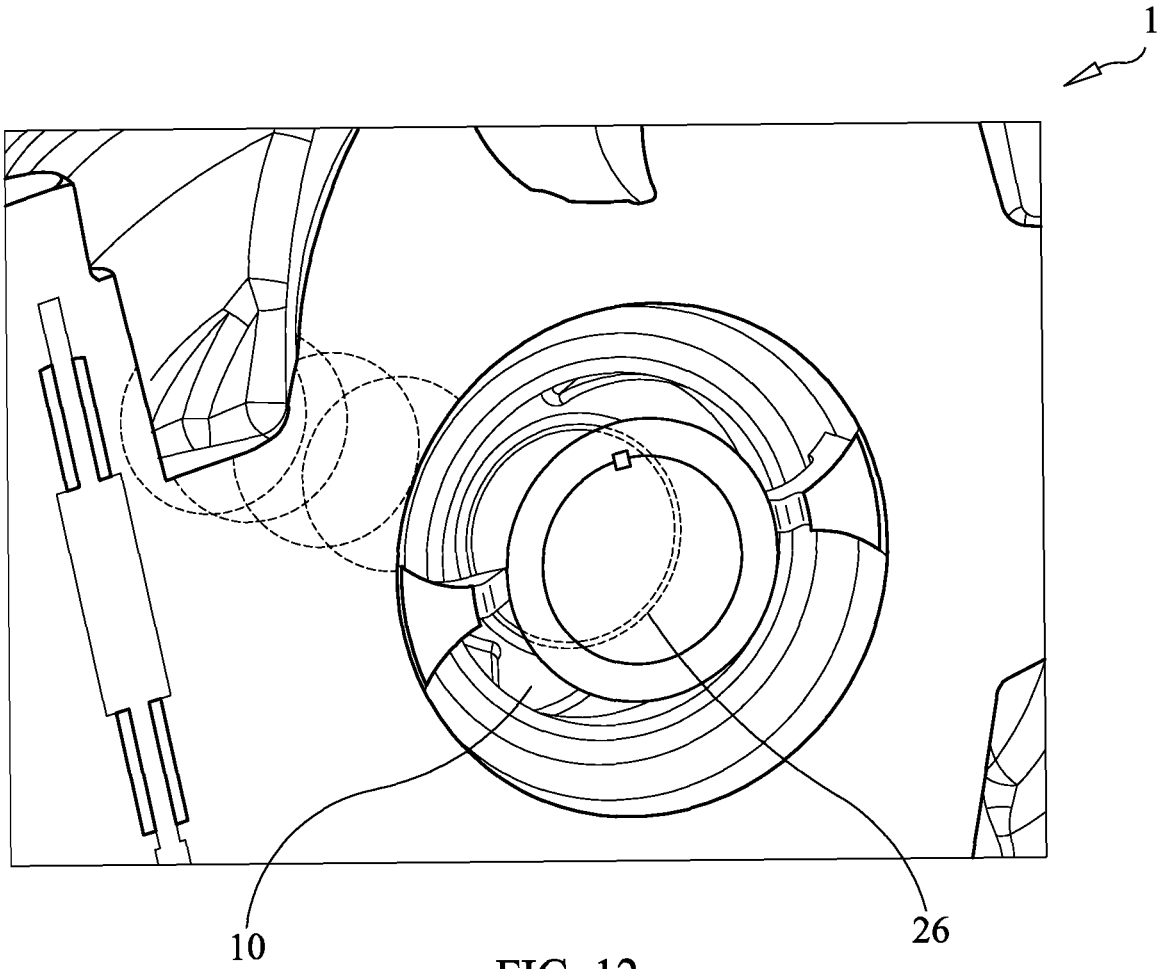
FIG. 12 is an enlarged view of the bridged stage piece shown in FIG. 11.

The post 38 has a first radial or outer circumferential end 48, a second radial or inner circumferential end 50, a first side 52, a second side 54, and an upper side or surface 56. In one embodiment, the first radial end 48 is arcuate, and the second radial end 50 extends radially inwardly of first and second rings 34 and 36. As shown in FIG. 4, the second radial end 50 can include a stepped portion or a radially inwardly extending protrusion 58.

The first side 52 and the second side 54 extend between the first radial end 48 and the second radial end 50. The first and second sides 52 and 54 extend generally in the radial direction and are arcuate. That is, each of the first and second sides 52 and 54 has an inwardly curved configuration and is configured to narrow the post 38 in a radially inward direction. Thus, the first and second sides 52 and 54 extend toward each other such that the first radial end 48 is longer that the second radial end 50. The upper surface 56 is angled in the axial direction A. Additionally, in one embodiment, the upper surface 56 has a curved configuration as it extends from the first ring 34 to the second end 50. The upper surface 56 is disposed between the first and second sides 52 and 54 and thus narrow in a radially inward direction toward the second end 50.

As shown in FIG. 4, the second end 50 generally extends from the upper surface 56 to the inner surface 42 of the second ring 36. Extending from the upper surface 56, the second end 50 has a surface 62 that angles radially outwardly in a direction transverse to the axial direction A. A surface 64 of the second end 50 then extends substantially perpendicular to the axial direction A (i.e., in the radial direction). A surface 66 of the second end 50 then extends substantially perpendicular to the radial direction (i.e., in the axial direction A or parallel to the axial direction A), forming the stepped portion or a radially inwardly extending protrusion 58, until the second end connects to the second ring 36.

In one embodiment, the first and second rings 34 and 36 are connected by two posts 38. The two posts 38 can have an identical (although) mirrored configuration. The second post 38 can be disposed between the first and second rings 34 and 36 in a position 180 degrees relative to the first post 38. It is noted that the rings can be connected by any number of posts (including one), and is not limited to two posts.

The post configuration disclosed herein can mimic the hydraulic contour of a flow passage in an upstream part of a casing 16 of the multistage pump 1, (the volute case). Thus, the structure of the posts limits the efficiency loss by effectively guiding the flow into the eye of the downstream impeller, saving energy.

Moreover, in one embodiment, the present invention has two posts 38. This is distinct from a conventional device, which typically has four bridging posts connecting the two rings. Two of the four conventional posts will inherently be positioned in the flow path, causing a reduction to the overall efficiency of the pump. Thus, this embodiment of the present invention will improve the overall efficiency of the pump.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A stage piece for a multistage pump, comprising:
a first ring;
a second ring; and
first and second posts connecting the first ring to the second ring, each of the first and second posts having a first radial end and a second radial end and a first side and a second side connecting the first and second ends, for each of the first and second posts, the first and second sides being arcuate and extending toward each other such that the first radial end is longer that the second radial end.

2. The stage piece according to claim 1, wherein for each of the first and second posts, the first radial end is arcuate.

3. The stage piece according to claim 1, wherein
for each of the first and second posts, the second radial end extends radially inwardly of first and second rings.

4. The stage piece according to claim 1, wherein the second post is disposed in a position 180 degrees relative to the first post.

5. The stage piece according to claim 1, wherein
at least one of the first and second posts includes an upper surface that is angled in an axial direction.

6. The stage piece according to claim 1, wherein
at least one of the first and second posts is configured to mimic a hydraulic contour of a flow passage in an upstream part of a casing of the multistage pump.

7. The stage piece according to claim 1, wherein
the first ring, the second ring and the first and second posts are unitarily formed as one piece.

8. The stage piece according to claim 1, wherein the first ring, the second ring and the first and second posts are cast as one piece.

9. The stage piece for a multistage pump, comprising:
a first ring;
a second ring;
a post connecting the first ring to the second ring having a first radial end and a second radial end and a first side and a second side connecting the first and second ends, the first and second sides being arcuate and extending toward each other such that the first radial end is longer that the second radial end, the second radial end includes a radially inwardly extending protrusion.

10. A multistage pump, comprising:
a pump casing defining a flow passage;
a shaft rotatably disposed within the pump casing and having a longitudinal axis;
a first impeller disposed within the casing at a first position along the shaft;
a second impeller disposed within the casing at a second position and along the shaft; and
a stage piece disposed in the flow passage and including a first ring, a second ring, and first and second posts connecting the first ring to the second ring, each of the first and second posts having a first radial end and a second radial end and a first side and a second side connecting the first and second ends, for each of the first and second posts, the first and second sides being arcuate and extending toward each other such that the first radial end is longer that the second radial end.

11. The multistage pump according to claim 10, wherein for each of the first and second posts, the first radial end is arcuate.

12. The multistage pump according to claim 10, wherein for each of the first and second posts, the second radial end extends radially inwardly of first and second rings.

13. The multistage pump according to claim 10, wherein the second post is disposed in a position 180 degrees relative to the first post.

14. The multistage pump according to claim 10, wherein at least one of the first and second posts includes an upper surface that is angled in a axial direction.

15. The multistage pump according to claim 10, wherein at least one of the first and second posts is configured to mimic a hydraulic contour of a flow passage in an upstream part of a casing of the multistage pump.

16. The multistage pump according to claim 10, wherein the first ring, the second ring and the first and second posts are unitarily formed as one piece.

17. The multistage pump according to claim 10, wherein the first ring, the second ring and the first and second posts are cast as one piece.

18. The multistage pump, comprising:
a pump casing defining a flow passage;
a shaft rotatably disposed within the pump casing and having a longitudinal axis;
a first impeller disposed within the casing at a first position along the shaft;
a second impeller disposed within the casing at a second position and along the shaft; and
a stage piece disposed in the flow passage and including a first ring, a second ring, and a post connecting the first ring to the second ring having a first radial end and a second radial end and a first side and a second side connecting the first and second ends, the first and second sides being arcuate and extending toward each other such that the first radial end is longer that the second radial end, the second radial end includes a radially inwardly extending protrusion.

* * * * *